United States Patent [19]

Lang et al.

[11] 4,244,808

[45] Jan. 13, 1981

[54] METHOD OF PROCESSING A HIGH-BOILING FRACTION OBTAINED IN THE CRACKING OF HYDROCARBONS

[75] Inventors: Udo Lang; Berndt Hörner, both of Munich; Hans J. Wernicke, Wolfratshausen, all of Fed. Rep. of Germany

[73] Assignee: Linde Aktiengesellschaft, Wiesbaden, Fed. Rep. of Germany

[21] Appl. No.: 76,828

[22] Filed: Sep. 19, 1979

[30] Foreign Application Priority Data

Sep. 21, 1978 [DE] Fed. Rep. of Germany ..... 2840986

[51] Int. Cl.[3] ..... C10G 53/32; C10G 9/14; C10G 53/04

[52] U.S. Cl. ..... 208/67; 208/57; 208/86; 208/102; 208/143; 585/319

[58] Field of Search ..... 208/57, 58, 67, 86, 208/70, 95, 96, 97, 100, 102, 143; 585/256, 261, 264, 266, 269-270, 324, 413

[56] References Cited

U.S. PATENT DOCUMENTS

| | | | |
|---|---|---|---|
| 2,729,589 | 1/1956 | Waghorne et al. | 208/309 |
| 2,943,050 | 6/1960 | Beavon | 208/309 |
| 3,779,895 | 12/1973 | Wilson et al. | 208/309 X |
| 3,839,484 | 10/1974 | Zimmerman et al. | 585/315 |
| 3,907,920 | 9/1975 | Starks | 208/57 X |
| 4,115,246 | 9/1978 | Sweany | 208/56 |
| 4,145,276 | 3/1979 | Cosyns et al. | 208/57 |
| 4,180,453 | 12/1979 | Franck et al. | 208/57 |
| 4,188,281 | 5/1978 | Wernicke et al. | 208/57 |

*Primary Examiner*—Delbert E. Gantz
*Assistant Examiner*—G. E. Schmitkons
*Attorney, Agent, or Firm*—Karl F. Ross

[57] ABSTRACT

A process for the treatment of a hydrocarbon fraction having a boiling point range beginning above 200° C. and obtained in the cracking of hydrocarbons, in which the polymeric component resulting from the cracking pyrolysis is removed and the remaining polymer-free hydrocarbon is subjected to hydrogenation under such reaction conditions that the product is high in monoaromatic components while the polyaromatics are removed therefrom.

14 Claims, 5 Drawing Figures

METHOD OF PROCESSING A HIGH-BOILING FRACTION OBTAINED IN THE CRACKING OF HYDROCARBONS

FIELD OF THE INVENTION

Our present invention relates to a method of treating, processing or working up a hydrocarbon fraction boiling above 200° C. and produced in the cracking of hydrocarbons so as to render this fraction useful, e.g. for fuel purposes.

BACKGROUND OF THE INVENTION

In the thermal cracking of hydrocarbons, relatively light starting materials such as ethane or propane, or hydrocarbon mixtures with a boiling point below 200° C., for example naphta, are generally preferred since these starting materials produce fewer byproducts. However, these starting materials are not always available in sufficient quantity and hence it is frequently necessary or desirable to subject heavier starting materials to pyrolytic or thermal cracking. In general, therefore, efforts have been made to develop processes for cracking high boiling starting materials and thereby rendering the same more useful.

The higher boiling starting materials, however, have been found to be problematic when subjected to thermal cracking since the cracking operation yields relatively large quantities of liquid cracking products in amounts which increase with increasing boiling point range of the starting materials. These liquid cracking products are generally separated into a fraction boiling below 200° C. and a fraction boiling above 200° C.

The lower boiling fraction constitutes a relatively high octane fuel and contains valuable components such as benzene, toluene and xylenes. By contrast, the higher boiling fraction, i.e. the fraction with a boiling range above 200° C., is a product difficult to treat or render useful and contains highly condensed aromatics, polymeric compounds sulfur compounds and heavy metal compounds. The proportion of this fraction, in the case of naphta cracking, can be between 1 and 5% by weight of the total product and with heavier starting material for the cracking operation, it increases so that in the case of gas oil, for example, it can amount to 30 weight percent with still higher values when the material subjected to cracking is vacuum gas oil or crude oil or a crude oil residual such as residual oil.

Furthermore, the sulfur originally present in the material subject to cracking is enriched in the heavy product fraction to such an extent that the combustion of the product fraction with dilution or treatment to remove sulfur, poses a serious environmental hazard.

Consequently, efforts have been made to cut the high-sulfur cracking-product fraction with low-sulfur fuels to avoid combustion gases which are toxic because of the sulfur content. The mixture of the heavy-cracking-product fraction with low-sulfur fuels, however, also poses problems since this fraction is only limitedly miscible with crude oil distillates and thus can only be cut in part by them. Another disadvantage of the heavy cracking product fraction is that it is difficult to store, handle and transport.

An economical process for working up or treating this heavy cracking-product fraction to render it more useful and to avoid the aforementioned problem has not been proposed heretofore.

For example, German Patent Document No. P 28 06 854.4 suggests that the cracking-product fraction boiling above 200° C. can be subjected to a treatment in which polymeric compounds are removed with the polymer-free fraction by hydrogenating it and the hydrogenated product subjected to thermal cracking. This process, however, requires uneconomically large quantities of hydrogen if the hydrogenated product is to have a quality which enables it to be useful economically as a feed for the cracking process.

OBJECTS OF THE INVENTION

It is the principal object of the present invention to provide a method of working up the high boiling fraction obtained from the cracking of hydrocarbon, i.e. that fraction with a boiling point range above 200° C., whereby the disadvantage of earlier systems are avoided.

Another object is to provide an improved method of treating this high boiling fraction so as to obtain a higher proportion of useful products and greater value therefrom than has been possible heretofore.

Still another object of the invention is to provide a method of processing this high boiling fraction which is economical and minimizes hydrocarbon loss.

SUMMARY OF THE INVENTION

These objects and others which will become apparent hereinafter are attained, in accordance with the present invention, in a method of treating, working up or processing the high boiling hydrocarbon fraction obtained from the cracking of hydrocarbon fraction obtained from the cracking of hydrocarbons, namely, that fraction with a boiling point range above 200° C., wherein the high boiling fraction, from which polymeric substances are separated, is subjected in a substantially polymer-free state to a hydrogenation under such reaction conditions that the resulting product contains a high concentration of monoaromatic components and some polyaromatic components which, according to the invention are removed.

The hydrocarbon fraction from which the polymeric components are removed is used as the feed for the hydrogenation and consists in significant part of polyaromatic components with only small amounts of monoaromatic components, paraffins and naphthenes. The hydrogenation of this fraction results in a cracking of the polycyclic rings to form monoaromatic compounds, naphthenes and paraffins.

While it has previously been proposed to recycle treated high boiling fractions obtained from a cracking process, after removal of the polymeric component, to this cracking process, the treatment conditions were generally designed to maximize the yield of paraffins and naphthenes since these substances, upon thermal cracking, give rise to high yields of olefins. The hydrogenation conditions were designed to emphasize these components. The monoaromatics in the high boiling fraction were for the most part intended to be transformed into paraffins and naphthenes as well.

With the system of the present invention, however, the hydrogenation treatment is carried out under significantly milder operating conditions to promote a high yield of monoaromatic compounds. Surprisingly and as contrasted with the earlier concepts when the polyaromatic compounds are removed from the monoaromatic-rich hydrogenation product, the resulting hydrocarbon fraction need not be subjected to thermal cracking by recycling to this stage and yet is highly useful as a fuel.

The separation of the polyaromatic compounds from the monoaromatic-rich hydrogenation fraction can be effected by rectification, e.g. in a rectification column, from the sump of which the polyaromatics are recovered. The polyaromatic component is found to be equivalent to a low sulfur fuel oil and can be burned, without significant problem.

The monoaromatic-rich head product can be used directly as high octane fuel for carburetor-type internal-combustion engines, e.g. as a gasoline. It has a relatively high octane rating significantly above that of the lower boiling cracking fraction formed in the cracking of heavy crude oil fractions.

An important advantage of the present invention is that the hydrogenation, under milder conditions then have been proposed earlier, has a significantly lower hydrogen consumption. The reduced hydrogenation consumption is observed in terms of a comparison of the weight proportions between carbon and hydrogen in the hydrogenated product. In earlier hydrogenation systems, this ratio was between 6:1 and 7:1 whereas the ratio with the present invention is between 9:1 and 12:1 with a carbon/hydrogen weight ratio of substantially 11:1 being most effective.

This difference in the weight ratio is reflected in the proportions which are used. For example, in the earlier systems 6 to 65 g of hydrogen are required for 1 kg of hydrocarbon while in the system of the present invention only 15 to 20 g of hydrogen are required per kg of hydrocarbon.

While the actual hydrogenation conditions will depend on various parameters and will vary with changes in these parameters, the critical parameters are the pressure, temperature and spatial velocity of the reactants through the reactor. The reactor can contain a catalyst and frequently the nature of the catalyst will determine other reaction conditions.

The preferred hydrogen treating catalysts of the present invention can be the usual sulfur resistant hydrogenation or hydrocracking catalysts having elements of groups VI–VIII of the Periodic Table (see pages 448–449 of the HANDBOOK OF CHEMISTRY AND PHYSICS. 41st Edition, Chemical Rubber Publishing Co., 1960). These elements can also be used in the form of their mixtures as elements or as oxides or sulfides and can be applied to usual catalyst carriers such as silica, alumina, alumino silicates or zeolitic carriers.

Especially effective results are obtained with hydrogenation catalysts containing at least one element selected from the group which consists of cobalt, nickel and iron with at least one element selected from the group which consists of molybdenum, tungsten and chromium. These elements may also be present in the form of their oxides or sulfides or both.

Particularly effective results are obtained with a pressure between 80 and 150 bar, a temperature between 350° C. and 450° C. and a spatial velocity between 0.4 and 1 l. of the high boiling hydrocarbon fraction per l. of catalyst filling per hour. According to yet another feature of the invention, the monoaromatic-ruch fraction which results after separation of the polyaromatics from the hydrogenated product, is subjected to a $C_6$ to $C_8$ hydrocarbon cut to leave a gasoline fraction or a product which can supplement a gasoline fraction. The resulting product has been found to be especially effective as a motor vehicle fuel.

The use of a single column for the separation of the polyaromatics and for the $C_6$ to $C_8$ cut has been found to produce a product which is especially low in polyaromatics, although these steps can be carried out in separate columns. Advantageously, the $C_6$ to $C_8$ cut is treated to remove aromatic components by extraction and the nonaromatic compounds of the gasoline fraction mixed therewith. The remaining fraction contains the economical benzene, toluene and xylene components and is referred to as the BTX fraction.

According to the invention, moreover, the BTX fraction is resolved into individual components by fractionation with the toluene being admixed with the gasoline as required to increase its octane rating.

According to another feature of the invention, the monoaromatic-rich fraction, after removal of the polyaromatics, is treated to increase its benzene yield. A $C_6$ to $C_8$ cut is then taken and is subjected to hydrodealkylation.

Hydrogen is required both for the hydrogenation treatment of the polymer-free high boiling hydrocarbon fraction obtained from the cracking operations and for the hydrodealkylation exceeds the hydrogen proportion of thermal cracking and raises it about the same level as the hydrogen requirements of the process described earlier. Nevertheless the process of the present invention, in this embodiment, has the advantage that the recovered benzene has a higher value than a hydrogenated product of gas oil quality for recycling to the termal cracking.

To cover the higher hydrogen requirements, a proportion of the methane produced in the hydrocarbon cracking is converted into a hydrogen-rich gas by steam reforming. Another way of covering the hydrogen requirement according to the invention is to gasify the residual obtained by removing the polymeric compounds from the cracking fraction boiling over 200° C. and then to separate the hydrogen from the resulting gas. The gasification can be effected by partial oxidation.

In a further feature of the invention, the pyrolysis gasoline fraction which results from the cracking of the hydrocarbon is combined with the monoaromatics. In this process, a high quality gasoline can be obtained.

It has also been found to be advantageous to treat the mixture or the pyrolysis gasoline prior to mixture for removal of the benzene or BTX fraction therefrom.

Of course additional aromatic-rich residual oils can be added as well at various locations in the process.

BRIEF DESCRIPTION OF THE DRAWINGS

The above and other features, objects and advantages of the present invention will become more readily apparent from the following description, reference being made to the accompanying drawing in which.

SPECIFIC DESCRIPTION AND EXAMPLES

Figure 1:
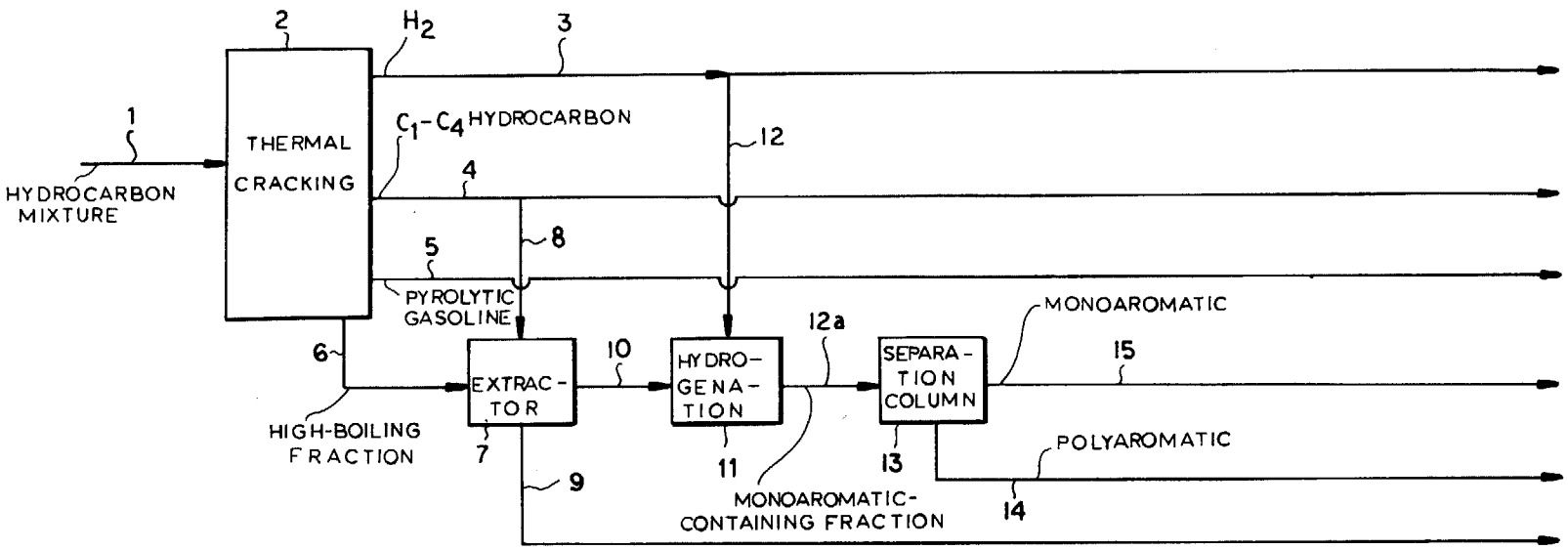
FIG. 1 is a flow diagram in which the hydrocarbon fraction having a boiling point above 200° C. and obtained from the pyrolytic cracking of hydrocarbons is recovered for use as a carburetor-fuel gasoline.

In all of the Figures of the drawing, similarly functioning process units and steps are represented with the same reference numerals.

In the embodiment of the process according to FIG. 1, a hydrocarbon mixture is introduced as illustrated at 1 into a thermal cracking step 2 of conventional design. The feed is preferably of heavy hydrocarbons with a boiling point range beginning above 200° C., for example a gas oil, vacuum gas oil or a hydrogenated vacuum gas oil.

The thermal cracking is carried out in step 2 under the usual conditions, e.g. in a tube reactor at a pressure between 1 and 5 bar, preferably between 2 and 3 bar, with an outlet temperature of the cracking gases between 700° C. and 1000° C., preferably between 800° C. and 860° C. The residence time of the hydrocarbon in the reaction zone is between 0.05 and 2 seconds, preferably between 0.1 and 0.5 second.

The hydrocarbon mixture is advantageously combined with steam at a rate of 0.4 to 1 kg of steam per kg of the hydrocarbon mixture.

The hot cracking gases are quenched in a conventional quenching cooler and are then resolved into cuts or fractions in a conventional manner not illustrated in the drawing. The gaseous cracking products include hydrogen which is led away as represented by line 3 and $C_1$ to $C_4$ hydrocarbons which are carried off via line 4.

The normally liquid components produced by the cracking operation and separated by the fractionation step include the pyrolysis gasoline fraction which is led away at 5 and a high boiling fraction which is carried off at 6. The pyrolysis gasoline fraction consists substantially of $C_5$ to $C_{11}$ hydrocarbons and has a boiling point range which, at its upper end, is about 200° C. The boiling fraction carried off at 6 has a boiling point range beginning above 200° C. and consists substantially of polyaromatic and polymeric compounds. This component also includes small amounts of paraffins, naphthenes and monoaromatic compounds as well as impurities such as sulfur compounds and heavy metal compounds.

The high boiling fraction is conducted via line 6 to an extraction column 7 in which the polymeric components are removed from this fraction. The extracting medium for this separation is usually a nonpolar organic compound, especially a low molecular weight n-alkane. The polymeric components are removed generally in solid form while the remaining components are dissolved in the extracting solvent.

The solvent is separated from the component soluble therein by conventional means, e.g. distillation and/or expansion at low pressure with the recovered solvent being recycled to the extraction stage and only losses of solvent being replaced.

In the drawing, line 8 represents the supply of fresh solvent to the system in the form of $C_3$ to $C_4$ hydrocarbons which are condensed from the gaseous cracking products carried off via line 4.

The solid polymeric compounds are withdrawn from the system as represented by the line 9 and constitute generally a bituminous product which can be used effectively for road and like asphalt construction. The quality of this product as a bitumen can be improved by adding to it small quantities of the polymer-free fraction if desired.

The polymer-free fraction is withdrawn from the extraction stage 7 as represented by the line 10 and is found, without further processing, to have suitability as a fuel oil of specification M.

According to the invention, this polymer-free fraction is subjected to hydrogenation at 11 with at least part of the hydrogen required for this purpose being supplied via line 12 from the cracking stage 2.

The hydrogenation is carried out under mild conditions, i.e. at a pressure of preferably 80 to 150 bar, at a temperature of around 400° C. and with the use of a conventional hydrogenation or hydrocracking catalyst. The hydrogenation conditions are so established relative to each other that the hydrogenated product recovered at 12*a* has a maximum concentration of monoaromatic compounds.

The hydrogenation product is found to have a monoaromatic content of about 40% or higher and also includes polyaromatic compounds in an amount between 10 and 35%.

The polyaromatic compounds are separated out of the monoaromatic-containing fraction in a separating column 13 and the polyaromatic component is led away via line 14. This component is effective for direct use as a low sulfur fuel oil.

The remaining monoaromatic-rich fraction is recovered at 15. This fraction can be used directly as a gasoline for carburetor-type internal-combustion engines.

EXAMPLE I

In the system of FIG. 1, 1537 parts by weight of a gas oil are supplied at 1 to the thermal cracking plant 2 which is operated under the conditions described. 7.5 parts by weight of hydrogen are recovered at line 3, 878.5 parts by weight $C_1$ to $C_4$ hydrocarbons are recovered at line 4, 330 parts by weight of pyrolysis gasoline are recovered at line 5 and 321 parts by weight of a high boiling hydrocarbon fraction are recovered at line 6 with a boiling-point range beginning above 200° C.

The high boiling hydrocarbon fraction of line 6 is subjected to extraction and 64 parts by weight of the polymer components are removed leaving 257 parts by weight of a polymer-free fraction which is hydrogenated with 5 parts by weight hydrogen. The hydrogenated product yields 47 parts by weight of heating oil and 215 parts by weight of monoaromatic-rich gasoline.

Figure 2:
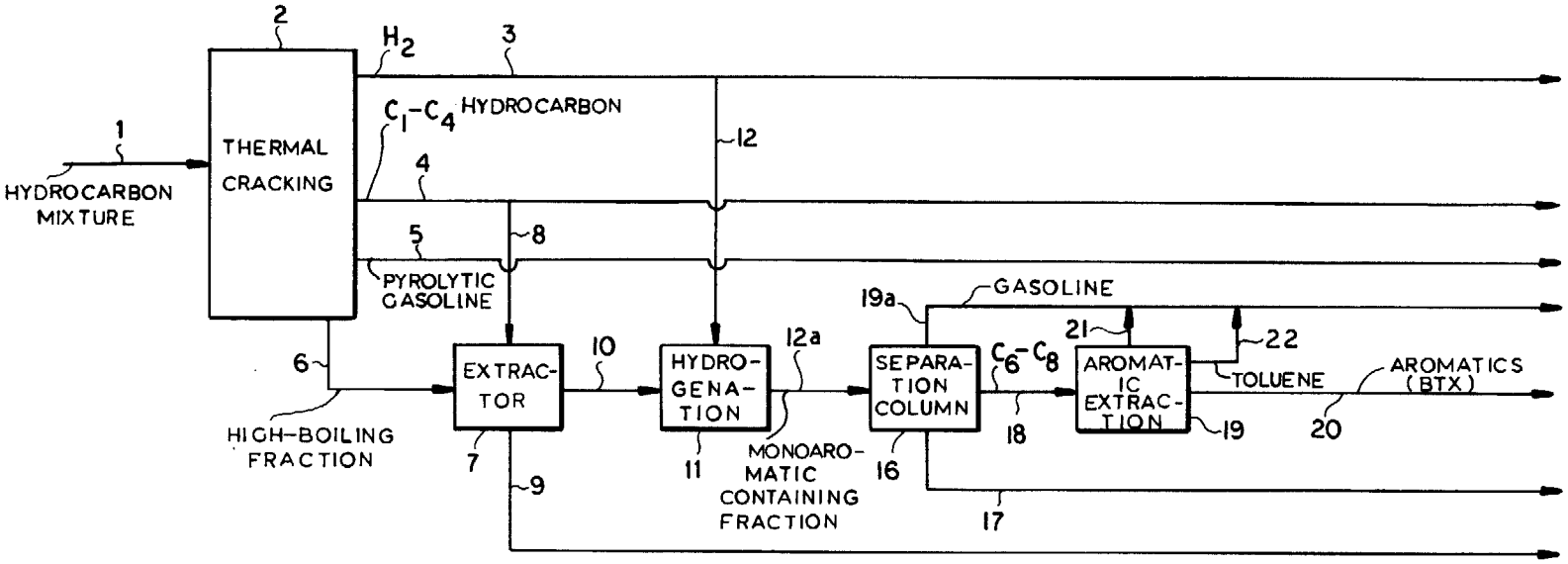
FIG. 2 is a flow diagram illustrating a process in which a benzene and xylene containing mixture as well as gasoline are recovered.

The process illustrated in FIG. 2 corresponds generally to that of FIG. 1 to the hydrogenation step at 11.

In this embodiment, however, the monoaromatic-rich hydrogenation product is fed to a separation column 16 in which not only is the polyaromatic component removed at line 7, but a hydrocarbon cut of $C_6$ to $C_8$ hydrocarbons is removed. This $C_6$ to $C_8$ fraction is fed at line 18 to a further stage described below. The remainder of the hydrogenated product is the gasoline which is led away at 19*a*.

According to the invention, the $C_6$ to $C_8$ hydrocarbon cut, which contains valuable aromatic components such as benzene, toluene and xylenes, is subjected to fractionation in an aromatic extraction stage 19.

The aromatics are withdrawn at 20 while the nonaromatic hydrocarbons are set at 21 to the gasoline of line 19*a*.

The aromatic fraction can be subjected to a BTX fractionation as previously described with the resulting toluene being added to the gasoline of 19*a* to increase its octane rating. This has been represented by the arrow 22a.

EXAMPLE II

In the process of FIG. 2, 1537 parts by weight of a gas oil is fed to the cracker 2 and the product yields in line 3 through 6, 9 and 10 corresponding to those given in Example I. The 257 parts by weight of the polymer-free fraction fed by line 10 to the hydrogenation stage 11 is hydrogenated by 4 parts by weight of hydrogen to 261 parts by weight of the hydrogenated product. This fraction is resolved in the separating stage 16 into 63 parts by weight of a polyaromatic component which constitutes a fuel oil fraction 104 parts by weight of $C_6$ to $C_8$ hydrocarbon fraction is recovered together with 94 parts by weight of a gasoline fraction.

33 parts by weight of benzenes and xylenes are recovered from the $C_6$ to $C_8$ fraction while the remaining 71 parts by weight thereof are supplied via lines 21 and 22 to the gasoline so that the total quantity of gasoline corresponds to 165 parts by weight.

Figure 3:
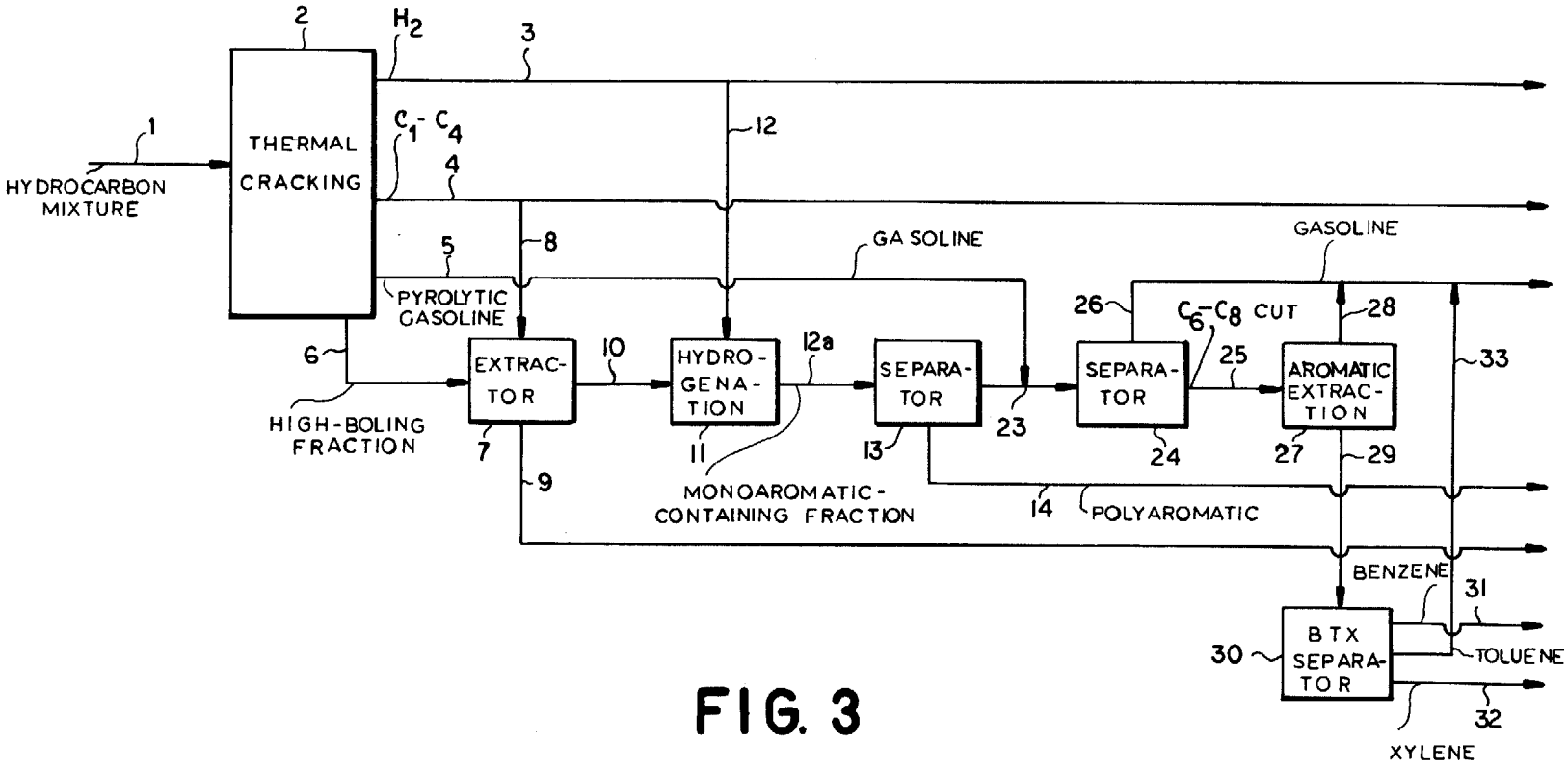
FIG. 3 is a flow diagram for a process of the present invention in which benzene and xylene are recovered and in which pyrolysis gasoline is combined with a hydrogenated product of the invention.

In the system of FIG. 3, the process described in FIGS. 1 and 2 is carried out up to the hydrogenation step and only the products beyond the hydrogenation step are treated differently.

According to this aspect of the invention, the separation at 13 yields a polyaromatic hydrogenation product which is mixed with the gasoline from line 5 of the cracker 2. The resulting mixture is then separated again at 24 to remove the $C_6$ to $C_8$ cut which is carried off at 25 with the remaining components being constituted as a gasoline at line 26.

The $C_6$ to $C_8$ cut is subjected to aromatic extraction as described in connection with FIG. 2 with the nonaromatic compound being fed at 28 to the gasoline of line 26.

Line 29 carries a mixture of benzene, toluene and xylenes away from the fractionation step and to a BTX separating stage 30. Benzene is recovered at 31, xylenes at 32 and toluene at 33. The toluene is mixed with the gasoline to increase the octane rating thereof.

The process is carried out under the conditions described in Example I up to the hydrogenation stage.

The 257 parts by weight of the polymeric fraction of line 10 is hydrogenated with 4 parts by weight of hydrogen to 261 parts by weight of the hydrogenated product which is separated into 63 parts by weight of the polyaromatic-rich fuel oil fraction and 198 parts by weight of a monoaromatic-rich fraction. This is mixed with 330 parts by weight of pyrolysis gasoline from line 5 and subjected to fractionation to remove 302 parts by weight of a $C_6$ to $C_8$ hydrocarbon fraction from 226 parts by weight of gasoline fraction. At the aromatic extraction stage 27, the 302 parts of weight of the $C_6$ to $C_8$ hydrocarbon fraction is subjected to further fractionation to yield 110 parts by weight of gasoline and 192 parts by weight of BTX fraction. This is resolved into 78 parts by weight benzene, 77 parts by weight toluene and 37 parts by weight xylene. The 77 parts by weight toluene is fed to the gasoline so that altogether 413 parts of weight of high octane gasoline is recovered.

Figure 4:
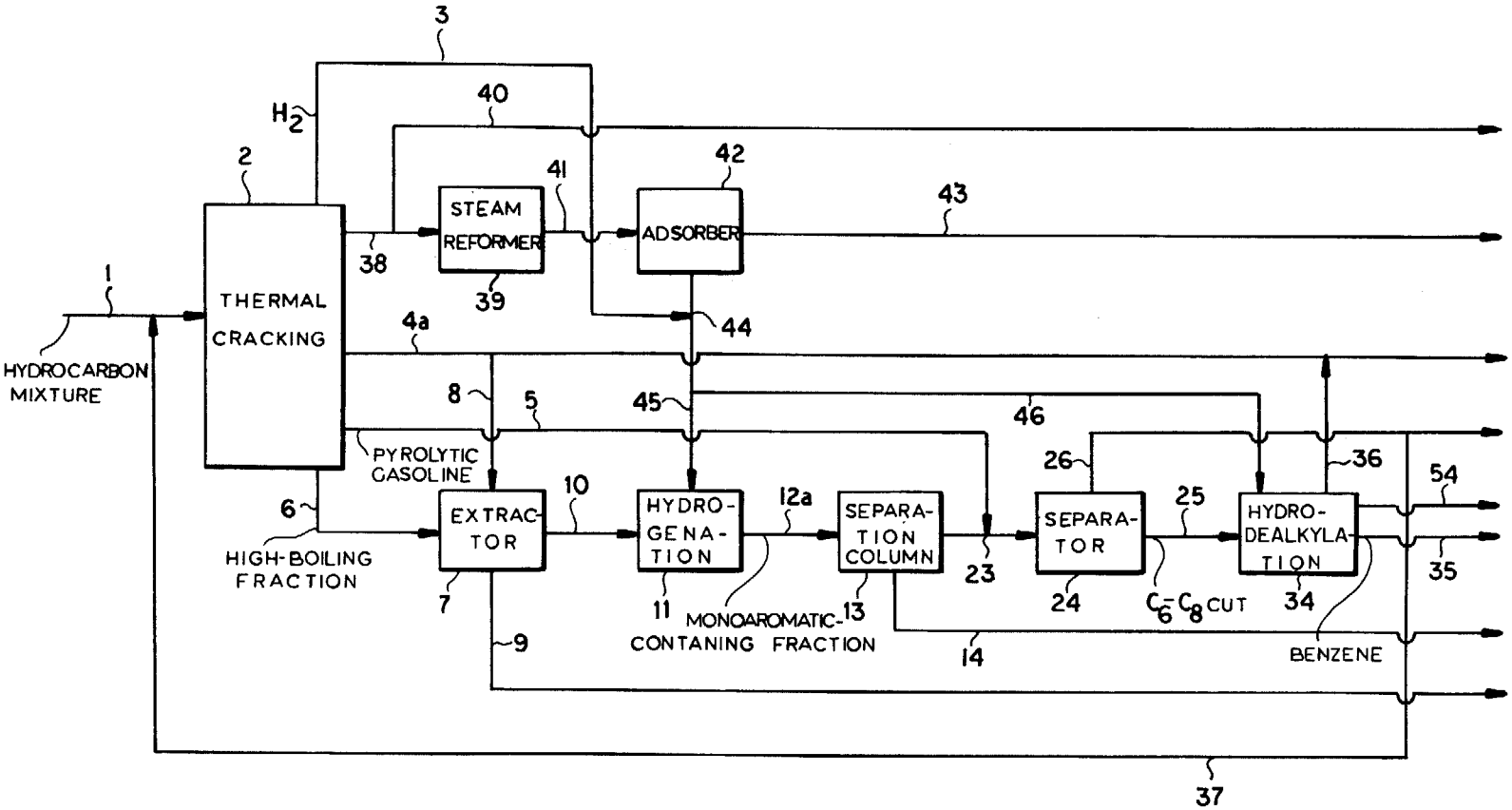
FIG. 4 is a flow diagram of a process inter alia for the recovery of benzene.
Figure 5:
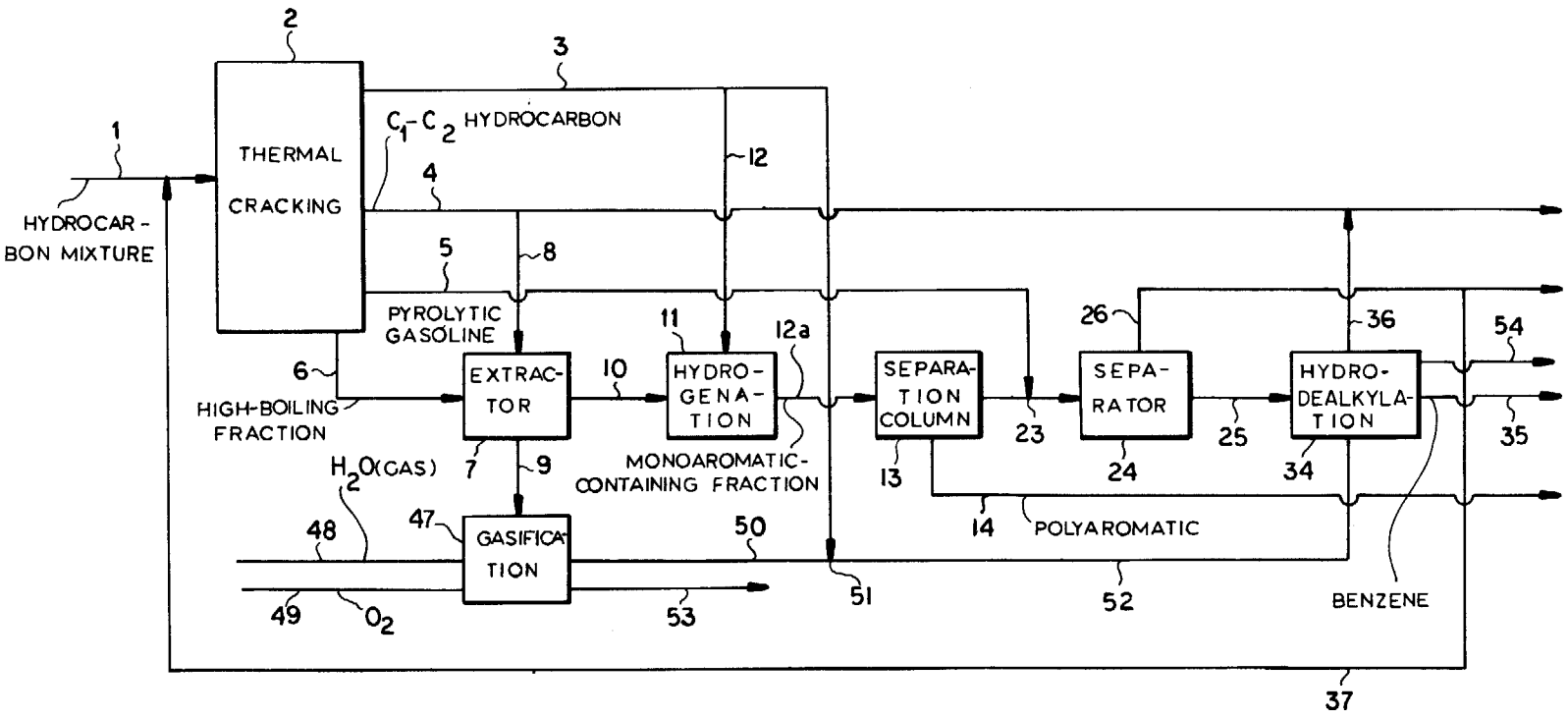
FIG. 5 is another flow diagram illustrating a process for the recovery of benzene.

The flow diagrams of FIGS. 4 and 5 show process variants which yield maximum amounts of benzene from the high boiling fraction obtained from the cracker 2, i.e. that fraction having a boiling point range above 200° C.

In this system, as in the system of FIG. 3, the high boiling fraction is subjected to hydrogenation, separation of polyaromatics and fractionation to recover a $C_6$ to $C_8$ cut at 24, all as described in connection with FIG. 3.

In addition, however, the $C_6$ to $C_8$ cut is fed at line 25 to a hydrodealkylation stage 34. Hydrogen is supplied to stage 34 via line 46 which branches from a line 45 collecting hydrogen at least in part from a line 3 leading from the cracker 2 in the manner described.

The benzene recovered upon hydrodealkylation is led away as the product of line 35. The nonaromatic compounds are led via line 36 to be mixed with the $C_2$ to $C_4$ hydrocarbons thereof and be cut thereby.

The gasoline fraction in line 26 has the quality of chemical benzene. It can be recycled via line 37 to cut the feed of line 1 and again be subjected to thermal cracking.

Since the hydrogen required for dehydrodealkylation at 34 cannot be obtained completely from line 3 of the cracking-generated hydrogen, the methane produced in the cracker is separated from the $C_1$ to $C_4$ fraction and is reformed to hydrogen.

Thus line 4a carries away only the $C_2$ to $C_4$ from the cracker. The methane is supplied as represented by line 38, partly to a steam reformed 39 while surplus methane is fed via line 40 from the system.

The gas mixture from the steam reformer, which consists primarily of hydrogen and carbon oxides, is separated in the adsorption stage 42 and the hydrogen component is fed at line 44 in part to the hydrogenation state 11 and in part to the hydrodealkylation stage 34 in admixture with the hydrogen from line 3. The methane produced by the hydrodealkylation can be recycled to the steam reformer 39 and converted to hydrogen.

EXAMPLE IV

With the system of FIG. 4 the operating conditions are the same up to the separation of the $C_6$ to $C_8$ fraction in column 24 as has been given in Example III.

302 parts by weight of the $C_6$ to $C_8$ reaction is subjected to hydrodealkylation with 13 parts by weight of hydrogen to yield 192 parts by weight benzene at line 35. 73 parts by weight of a $C_2$ to $C_4$ fraction are recovered via line 36 and 50 parts by weight of a methane hydrogen mixture are carried off at line 54.

7.5 parts by weight of hydrogen are delivered by line 3 to the hydrogen-consuming stages and 38 parts by weight of the cracking methane are steam reformer at 39 to produce a gas mixture of 9.5 parts by weight hydrogen and 28 parts by weight carbon oxides. This hydrogen is also fed to the hydrogen consuming stages.

In the process of FIG. 5, which operates similarly to that of FIG. 4, the hydrogen for the hydrodealkylation is generated by thermally decomposed of gasifying the polymer compounds recovered at 9 from the extract stage 7. The gasification is carried out in the thermal decomposition stage 47, e.g. with partial oxidation, lines 48 supplying water vapor and oxygen, air or enriched air, respectively. The resulting gas mixture contains, apart from hydrogen, carbon oxides and, when air is used, nitrogen, as well as impurities such as hydrogen sulfide. The gases are separated and the hydrogen is fed at line 50 to a mixer represented in 51 where cracking hydrogen from line 3 is combined therewith to produce a hydrogen which is fed at line 52 to the hydrodealkylation stage. The remaining gases produced in the gasification process are led away at 53 and form effective heating gas.

EXAMPLE V

The products are the same as those of Example IV except that the methane is present together with the $C_2$ to $C_4$ fraction in a $C_1$ to $C_4$ fraction while the 64 parts by weight of the polymer component at line 9 is reacted with 31 parts by weight steam and 50 parts by weight oxygen to a gas mixture from which 9.5 parts by weight hydrogen is recovered, the remaining 135.5 parts by weight serving as a heating gas.

We claim:

1. In a process in which a hydrocarbon mixture is subjected to thermal cracking to produce at least one hydrocarbon fraction having a boiling point range up to about 200° C. and a high-boiling cracking fraction having a boiling point range above about 200° C. in a cracking product containing polymeric components, the improvement which comprises the steps of:

removing said polymeric components from said high boiling cracking fraction;

hydrogenating the high boiling cracking fraction from which said polymer components have been removed to produce a hydrogenation product;

controlling the hydrogenation conditions for the high-boiling cracking fraction so that said hydrogenated product has a high monoaromatic content; and separating polyaromatics from the hydrogenated product.

2. The improvement defined in claim 1 wherein the hydrogenation is carried out on a hydrogenation catalyst to yield a hydrogenated product having a weight ratio of carbon to hydrogen between substantially 0:1 and 12:1 at a pressure between 80 and 150 bar, at a temperature between 350° C. and 450° C. and with a spatial velocity between 0.4 and 1 liter of high-boiling cracking fraction per liter of the catalyst.

3. The improvement defined in claim 2 wherein the hydrogen required for the hydrogenation is separated from a gas mixture formed by the cracking.

4. The improvement defined in claim 1, further comprising the steps of separating a $C_6$–$C_8$ hydrocarbon fraction from the hydrogenated product upon the removal of polyaromatics therefrom.

5. The improvement defined in claim 4 wherein the separation of the polyaromatics and a $C_6$–$C_8$ cut from the hydrogenated product is carried out in one separating unit.

6. The improvement defined in claim 4 wherein said hydrocarbon fraction of the cracking having a boiling point up to 200° C. is a pyrolysis gasoline fraction and is mixed with the hydrogenated product upon removal of the $C_6$–$C_8$ hydrocarbon cut and the polyaromatics therefrom.

7. The improvement defined in claim 4, further comprising subjecting the $C_6$–$C_8$ hydrocarbon cut to an aromatic extraction to separate an aromatic component thereof from a nonaromatic component thereof.

8. The improvement defined in claim 7 wherein the nonaromatic component is mixed with a pyrolysis gasoline fraction produced during the cracking period.

9. The improvement defined in claim 7 wherein the aromatic fraction is subjected to fractionation into benzene, toluene and xylenes.

10. The improvement defined in claim 9 wherein the toluene is admixed with gasoline produced by the cracking.

11. The improvement defined in claim 9 wherein the toluene is admixed with gasoline recovered from the hydrogenated product.

12. The improvement defined in claim 4, further comprising hydrodealkylating the $C_6$–$C_8$ hydrocarbon cut.

13. The improvement defined in claim 12 wherein at least part of the hydrogen required for the hydrodealkylating is obtained by reforming methane produced by cracking with steam.

14. The improvement defined in claim 12 wherein at least part of the hydrogen for hydrodealkylation is obtained by gasification of the polymer components removed from the high boiling fraction prior to dehydrogenation thereof.

* * * * *